US011635711B2

(12) United States Patent
Masuda et al.

(10) Patent No.: US 11,635,711 B2
(45) Date of Patent: Apr. 25, 2023

(54) IMAGE FORMING METHOD AND IMAGE FORMING APPARATUS

(71) Applicant: RICOH COMPANY, LTD., Tokyo (JP)

(72) Inventors: Minoru Masuda, Shizuoka (JP); Kazumi Suzuki, Shizuoka (JP); Toyoshi Sawada, Shizuoka (JP); Akira Azami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 63 days.

(21) Appl. No.: 17/206,422

(22) Filed: Mar. 19, 2021

(65) Prior Publication Data

US 2021/0311416 A1 Oct. 7, 2021

(30) Foreign Application Priority Data

Apr. 7, 2020 (JP) ..... JP2020-068941

(51) Int. Cl.

| | |
|---|---|
| ***G03G 9/087*** | (2006.01) |
| ***G03G 15/16*** | (2006.01) |
| ***G03G 9/09*** | (2006.01) |
| ***G03G 15/20*** | (2006.01) |

(52) U.S. Cl.

CPC ..... *G03G 15/16* (2013.01); *G03G 9/08704* (2013.01); *G03G 9/092* (2013.01); *G03G 9/0918* (2013.01); *G03G 15/2057* (2013.01)

(58) Field of Classification Search

CPC ..... G03G 9/08704; G03G 9/08782

See application file for complete search history.

(56) References Cited

U.S. PATENT DOCUMENTS

| | | | | |
|---|---|---|---|---|
| 5,851,713 | A * | 12/1998 | Hayashi | G03G 9/0819 430/109.3 |
| 9,304,451 | B1 | 4/2016 | Suwabe et al. | |
| 2011/0311908 | A1 | 12/2011 | Schulze-Hagenest | |
| 2012/0288791 | A1* | 11/2012 | Sakashita | G03G 9/08797 430/108.4 |

(Continued)

FOREIGN PATENT DOCUMENTS

| | | |
|---|---|---|
| EP | 3 299 892 | 3/2018 |
| JP | 11-249338 | 9/1999 |

(Continued)

OTHER PUBLICATIONS

Extended European Search Report received for EP Application No. 21161342.7, dated Aug. 24, 2021, 6 pages.

(Continued)

*Primary Examiner* — Peter L Vajda

(74) *Attorney, Agent, or Firm* — Grüneberg and Myers, PLLC

(57) ABSTRACT

An image forming method is provided. The image forming method includes: forming an electrostatic latent image on an electrostatic latent image bearer; developing the electrostatic latent image on the electrostatic latent image bearer with a toner to form a toner image; transferring the toner image from the electrostatic latent image bearer onto a continuous resin film; fixing the toner image on the continuous resin film with a heat roller or a heat belt. The toner contains a maleic-acid-modified polyolefin having a polypropylene block in a main chain.

14 Claims, 2 Drawing Sheets

(56) References Cited

U.S. PATENT DOCUMENTS

| | | | | |
|---|---|---|---|---|
| 2013/0344430 | A1* | 12/2013 | Terauchi ..... | G03G 9/08755 430/109.3 |
| 2016/0216689 | A1 | 7/2016 | Kiuchi et al. | |
| 2017/0097582 | A1* | 4/2017 | Moriya ..... | G03G 9/08755 |
| 2020/0301298 | A1 | 9/2020 | Inoue et al. | |
| 2020/0310324 | A1 | 10/2020 | Tanaka et al. | |
| 2020/0333720 | A1 | 10/2020 | Sawada et al. | |

FOREIGN PATENT DOCUMENTS

| | | |
|---|---|---|
| JP | 2008-195933 | 8/2008 |
| JP | 2014-231602 | 12/2014 |
| JP | 2018-36532 | 3/2018 |
| JP | 2018-059036 | 4/2018 |
| JP | 2019-132894 | 8/2019 |
| JP | 2020-177084 | 10/2020 |

OTHER PUBLICATIONS

U.S. Appl. No. 17/076,990, filed Oct. 22, 2020, Toshihiko Sugiyama, et al.

* cited by examiner

IMAGE FORMING METHOD AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2020-068941, filed on Apr. 7, 2020, in the Japan Patent Office, the entire disclosure of which is hereby incorporated by reference herein.

BACKGROUND

Technical Field

The present disclosure relates to an image forming method and an image forming apparatus.

Description of the Related Art

An electrophotographic method is an image forming method to form a visible image by developing an electrostatic latent image with a developer. Specifically, an electrostatic latent image is formed on an electrostatic latent image bearer (also referred to as "photoconductor") containing a photoconductive substance, then the electrostatic latent image is developed with a developer containing toner to form a toner image, and the toner image is transferred onto a recording medium such as a paper sheet and fixed thereon by heat and pressure to form a fixed image.

To form a full-color image by the electrophotographic method, a toner set containing black toner in combination with cyan, magenta, and yellow toners, which are toners of three process colors, is generally used.

In recent years, as electrophotographic color image forming apparatuses have become widespread, the uses of the printed products thereof have been diversified. Particularly in the field of printing on packaging materials, there is an increasing need for an electrophotographic printing method that makes it possible to make print on packaging materials which cannot make print with (cannot fix) conventional electrophotographic toners designed to be printed on paper media. Specifically, there is a growing need for printing technique on plastic film media frequently used for food packaging materials. It has been conventionally confirmed that, when toner is improved in fixability by changing thermal characteristics at the expense of releasability, undesirable phenomena such as hot offset and sheet wrapping around the fixing roller ("waste sheet jam") occur. Electrophotographic image forming method and apparatus that provide excellent fixability on plastic film media and excellent releasability have not been proposed yet.

SUMMARY

In accordance with some embodiments of the present invention, an image forming method is provided. The image forming method includes: forming an electrostatic latent image on an electrostatic latent image bearer; developing the electrostatic latent image on the electrostatic latent image bearer with a toner to form a toner image; transferring the toner image from the electrostatic latent image bearer onto a continuous resin film; fixing the toner image on the continuous resin film with a heat roller or a heat belt. The toner contains a maleic-acid-modified polyolefin having a polypropylene block in a main chain.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
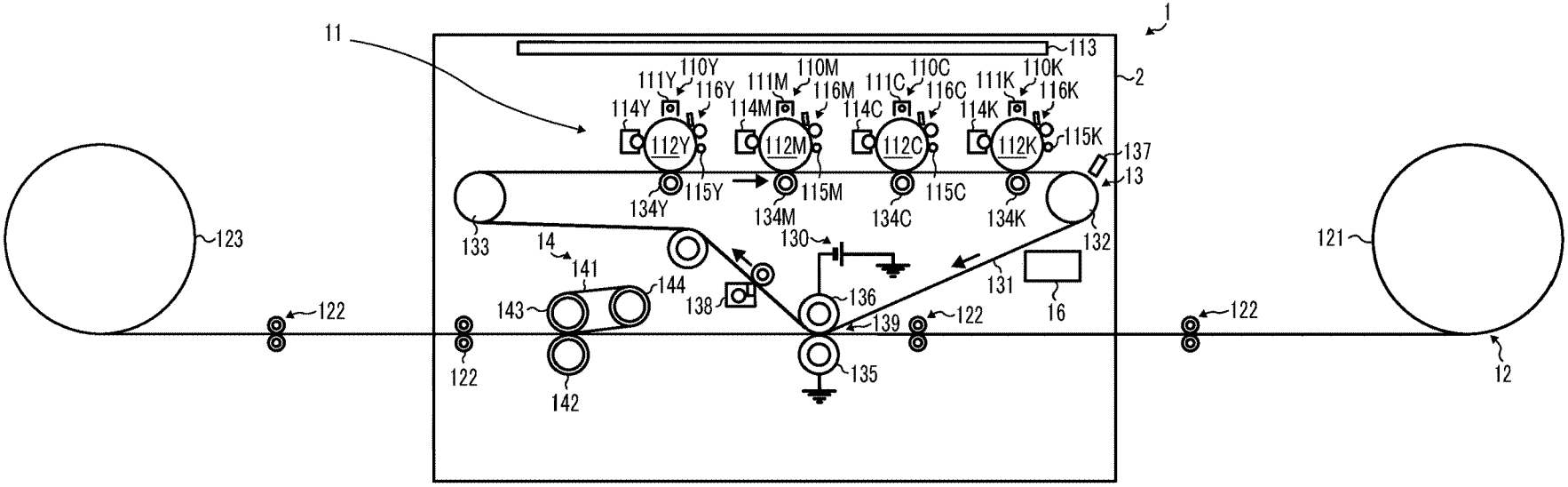
FIG. 1 is a schematic diagram of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, an image forming method is provided that enables toner to be fixed on plastic films on which conventional toners are unfixable.

The image forming method of the present disclosure uses a toner containing a maleic-acid-modified polyolefin having a polypropylene block in the main chain.

Hereinafter, the toner, a developer containing the toner, and an image forming apparatus accommodating the toner are described with reference to the drawings. Incidentally, it is to be noted that the following embodiments are not limiting the present invention and any deletion, addition, modification, change, etc. can be made within a scope in which person skilled in the art can conceive including other embodiments, and any of which is included within the scope of the present invention as long as the effect and feature of the present invention are demonstrated.

Structure, Content, ½ Outflow Temperature, Molecular Weight, and Acid Modification Rate of Maleic-acid-modified Polyolefin Having Polypropylene Block in Main Chain Preferably, the toner of the present disclosure contains a polyolefin having a polypropylene block in the main chain, whose terminal or side chain is modified with maleic acid, as a binder resin. The inventors of the present invention have found that such a toner has significantly improved in fixability on plastic films. It is sufficient that the main chain has a polypropylene block. Preferably, the main chain is a block copolymer having at least one of polyethylene block and polybutene block in addition to the polypropylene block.

The proportion of the maleic-acid-modified polyolefin having a polypropylene block in the main chain in the toner is preferably from 1.0% to 20.0% by mass. When the proportion is 1.0% by mass or more, fixability of the toner on plastic films is sufficient. When the proportion is 20.0% by mass or less, the occurrence of hot offset is prevented at the time of fixing of the toner.

Preferably, the maleic-acid-modified polyolefin having a polypropylene block in the main chain has a ½ outflow temperature of from 95° C. to 150° C. When the ½ outflow temperature is 95° C. or higher and when the ½ outflow temperature is 150° C. or lower, fixability of the toner on plastic films is sufficient.

Preferably, the maleic-acid-modified polyolefin having a polypropylene block in the main chain has a weight average molecular weight of 30,000 or more. When the weight average molecular weight is 30,000 or more, the maleic-acid-modified polyolefin does not function as a release agent and therefore improves fixability on plastic films. More preferably, the maleic-acid-modified polyolefin having a polypropylene block in the main chain has a weight average molecular weight of 60,000 or more. Much more preferably, the weight average molecular weight is from 80,000 to 100,000. When the weight average molecular weight is 100,000 or less, the ½ outflow temperature and melt viscosity do not become too high, so that fixability on plastic films is sufficient.

Preferably, the maleic-acid-modified polyolefin having a polypropylene block in the main chain has a maleic acid modification rate of from 0.5% to 8.0% by mass. When the maleic acid modification rate is within this range, at the time when the toner is melting, the maleic-acid-modified polyolefin having a polypropylene block in the main chain exudes to the interface between the film and the toner, achieving good fixability.

Type and Amount of Wax

The toner of the present disclosure may contain a wax as a release agent. The type of the wax is not particularly limited and can be suitably selected to suit to a particular application. One type of wax may be used alone, or two or more types of waxes may be used in combination. Specific examples of the release agent include, but are not limited to, aliphatic hydrocarbons such as liquid paraffin, micro-crystalline wax, natural paraffin, synthetic paraffin, and polyolefin wax, and partial oxides, fluorides, and chlorides thereof; animal oils such as beef tallow and fish oil; vegetable oils such as coconut oil, soybean oil, rapeseed oil, rice bran wax, and carnauba wax; higher aliphatic alcohols and higher fatty acids such as montan wax; fatty acid amides and fatty acid bisamides; metal soaps such as zinc stearate, calcium stearate, magnesium stearate, aluminum stearate, zinc oleate, zinc palmitate, magnesium palmitate, zinc myristate, zinc laurate, and zinc behenate; fatty acid esters; and polyvinylidene fluoride. In particular, ester waxes, including fatty acid esters, are preferred. When the toner contains the maleic-acid-modified polyolefin having a polypropylene block in the main chain in too large amounts, the toner and the fixing roller (or fixing belt) are inseparable from each other at the time of fixing the toner, and waste sheet jam may occur. The inventors of the present invention have found that this undesirable phenomenon is prevented when the toner contains an ester wax as a release agent. Further, the inventors have found that the maleic-acid-modified polyolefin having a polypropylene block in the main chain has an effect of finely dispersing the ester wax.

The proportion of the wax in the toner is preferably from 0.1% to 8.0% by mass. When the proportion is 0.1% by mass or more, the toner and the fixing roller (or fixing belt) are separable from each other at the time of fixing the toner, and waste sheet jam does not occur. When the proportion is 8.0% by mass or less, fixability of the toner on plastic films is sufficient.

½ Outflow Temperature of Toner

The ½ outflow temperature of the toner of the present disclosure is desirably as low as possible so long as heat-resistant storage stability and hot offset resistance of the toner do not deteriorate, and is preferably from 100° C. to 115° C. When the ½ outflow temperature is 100° C. or higher, heat-resistant storage stability and hot offset resistance of the toner are improved. When the ½ outflow temperature is 115° C. or lower, the toner sufficiently melts when being fixed on a plastic film and increases the contact area, providing sufficient fixability of the toner on plastic films.

The ½ outflow temperature of the toner can be adjusted by the binder resin of the toner.

Component Analysis by GC-MS

Confirmation of the presence of the maleic-acid-modified polyolefin having a polypropylene block in the main chain in the toner and quantification thereof can be performed by the following procedures, instruments, and conditions.

[Specimen Treatment]

The toner is dispersed in chloroform and stirred overnight. Subsequently, the resultant dispersion liquid is centrifuged, and only the supernatant is collected. The collected supernatant is evaporated to dryness, thus preparing a sample to be subjected to a composition analysis by GC-MS. When the other components such as a binder resin and a release agent are dissolved in this dispersion liquid, the analysis is performed using a peak specific to the maleic-acid-modified polyolefin having a polypropylene block in the main chain.

A specimen is prepared by dropping about 1 μL of a methylating agent (20% methanol solution of tetramethylammonium hydroxide (TMAH)) into about 1 mg of a sample.

[Measurement]

Pyrolysis-gas chromatography-mass spectrometer (Py-GCMS)

Analyzer: QP2010 manufactured by Shimadzu Corporation

Heating furnace: Py2020D manufactured by Frontier Laboratories Ltd.

Heating temperature: 320° C.

Column: Ultra ALLOY-5, L=30 m, ID=0.25 mm, Film=0.25 μm

Column temperature: 50° C. (held for 1 minute)→temperature rise (at 10° C./min)→340° C. (held for 7 minutes)

Split ratio: 1:100

Column flow rate: 1.0 ml/min

Ionization method: EI method (70 eV)

Measurement mode: Scan mode

Search data: NIST 20 MASS SPECTRAL LIB.

Component Analysis by Nuclear Magnetic Resonance (NMR)

Confirmation of the presence of the maleic-acid-modified polyolefin having a polypropylene block in the main chain in the toner and quantification thereof can be performed by the following procedures, instruments, and conditions.

[Specimen Preparation]

The toner is dispersed in chloroform and stirred overnight. Subsequently, the resultant dispersion liquid is centrifuged, and only the supernatant is collected. The collected supernatant is evaporated to dryness, thus preparing a sample to be subjected to a composition analysis by NMR. When the other components such as a binder resin and a release agent are dissolved in this dispersion liquid, the analysis is performed using a peak specific to the maleic-acid-modified polyolefin having a polypropylene block in the main chain.

(1) For $^{1}$H-NMR

To the above-prepared sample in an amount of 100 mg, 1 mL of d8-toluene is added and heated by a dryer to be dissolved therein, thus preparing a specimen for $^{1}$H-NMR measurement.

(2) For $^{13}$C-NMR

To the above-prepared sample in an amount of 100 mg, 1 mL of deuterated 1,2-dichlorotoluene is added and heated by a dryer to be dissolved therein, thus preparing a specimen for $^{13}$C-NMR measurement.

[Analysis Instruments and Measurement Conditions]

NMR equipment: ECX-500 manufactured by JEOL Ltd.

(1) Measurement nucleus=$^{1}$H (500 MHz), measurement pulse file=single pulse dec.jxp (1H), 45° C. pulse, integration=20,000 times, relaxation delay=4 seconds, data point 0=32K, offset=100 ppm, observation width=250 ppm, measurement temperature=70° C.

(2) Measurement nucleus=$^{13}$C (125 MHz), measurement pulse file=single pulse dec.jxp (13C), 45° C. pulse, integration=64 times, relaxation delay=5 seconds, data point=32K, observation width=15 ppm, measurement temperature=65° C.

Method of Measuring Weight Average Molecular Weight

The weight average molecular weight of the maleic-acid-modified polyolefin having a polypropylene block in the main chain is determined by measuring a molecular weight distribution of THF-soluble matter thereof using a GPC (gel permeation chromatography) measuring instrument GPC-150C (manufactured by Waters Corporation).

The measurement is conducted using columns (SHODEX KF 801 to 807 manufactured by Showa Denko K.K.) as follows. The columns are stabilized in a heat chamber at 40° C. Tetrahydrofuran (THF) as a solvent is let to flow in the columns at that temperature at a flow rate of 1 milliliter per minute. Next, 0.05 g of a sample is thoroughly dissolved in 5 g of THF and filtered with a pretreatment filter (e.g., a chromatographic disk having a pore size of 0.45 μm, manufactured by KURABO INDUSTRIES LTD.) to prepare a THF solution of the sample having a sample concentration of from 0.05% to 0.6% by mass, and 50 to 200 μL thereof is injected in the measuring instrument.

The weight average molecular weight (Mw) and the number average molecular weight (Mn) of the THF-soluble matter in the sample are determined by comparing the molecular weight distribution of the sample with a calibration curve that has been created with several types of monodisperse polystyrene standard samples. Specifically, the calibration curve shows the relation between the logarithmic values of molecular weights and the number of counts.

The polystyrene standard samples for creating the calibration curve are those having molecular weights of $6\times10^{2}$, $2.1\times10^{3}$, $4\times10^{3}$, $1.75\times10^{4}$, $5.1\times10^{4}$, $1.1\times10^{5}$, $3.9\times10^{5}$, $8.6\times10^{5}$, $2\times10^{6}$, and $4.48\times10^{6}$, respectively, manufactured by Pressure Chemical Co. or Toyo Soda Manufacturing Co., Ltd. Preferably, about 10 standard polystyrene samples are used. As the detector, a refractive index (RI) detector is used.

Method of Measuring ½ Outflow Temperature

The ½ outflow temperature of the maleic-acid-modified polyolefin having a polypropylene block in the main chain and the ½ outflow temperature of the toner are measured using a flowtester (CFT-500D manufactured by Shimadzu Corporation) as follows. First, 1.0 g of a sample is applied with a load of 1.96 MPa by a plunger while being heated at a temperature rising rate of 6° C./min and extruded from a nozzle having a diameter of 1.0 mm and a length of 1.0 mm. The amount of decent of the plunger in the flowtester is plotted against the temperature to draw a curve on a graph, and a temperature at which half of the sample has been flowed out is defined as the ½ outflow temperature.

Color of Toner

Toners of the present disclosure include at least yellow toner, cyan toner, magenta toner, and black toner, and may further include toners of other colors as needed.

The toner of the present disclosure may contain a colorant. The colorant is not particularly limited, and commonly used colorants can be appropriately selected and used.

Preferred examples of colorants for black toner include carbon black alone, and a mixture of carbon black as a main component with copper phthalocyanine, whose hue and lightness had been adjusted.

Preferred examples of colorants for cyan toner include, but are not limited to, copper phthalocyanines such as Pigment Blue 15:1, Pigment Blue 15:2, Pigment Blue 15:3, and Pigment Blue 15:4.

Examples of colorants for magenta toner include, but are not limited to, Pigment Red 53: 1, Pigment Red 81, Pigment Red 122, Pigment Red 269, and combinations thereof.

Examples of colorants for yellow toner include, but are not limited to, Pigment Yellow 74, Pigment Yellow 155, Pigment Yellow 180, Pigment Yellow 185, and combinations thereof. Preferred is Pigment Yellow 185 alone or a mixture of Pigment Yellow 185 with Pigment Yellow 74 for chroma and storability.

Examples of the white pigments include, but are not limited to, titanium dioxide which is surface-treated with silicon, zirconia, aluminum, or polyol.

Examples of colorants for green toner include, but are not limited to, Pigment Green 7, which should be used paying attention to safety.

Examples of colorants for blue toner include, but are not limited to, Pigment Blue 15:1 and Pigment Violet 23.

In the case of using images obtained according to the present disclosure for packaging foods or the like, for safety reason, it is preferable that Pigment Yellow 185, copper phthalocyanine, and Pigment Red 122 be used as colorants for the yellow toner, cyan toner, and magenta toner, respectively.

When an image is formed on a thin resin film, if the amount of deposition of toner is large, a portion to which the toner is deposited becomes harder than another portion to which the toner is not deposited. To make the hardness uniform, it is desirable that the amount of deposition of toner is as small as possible. Therefore, it is desirable to increase the degree of coloring of the toner. The proportion of pigment in the toner is preferably from 2% to 30% by mass, and more preferably from 10% to 20% by mass. When the proportion of pigment in the toner is 2% by mass or more, the image density is sufficient. When it is 10% by weight or more, the amount of deposition of the toner can be reduced, and the occurrence of curling of the film can be prevented without damaging the sufficient image density and softness of the film. When the proportion of pigment in the toner is 30% by mass or less, the adhesiveness between the resin film and the toner can be maintained. When it is 20% by mass or less, the adhesiveness becomes more sufficient.

Binder Resin

In the present disclosure, the binder resin (resin for fixation) of the toner may contain a conventionally-known resin in combination with the maleic-acid-modified polyolefin having a polypropylene block in the main chain. Examples thereof include, but are not limited to, styrene-based resins (e.g., homopolymers and copolymers comprising styrene or a styrene-substituted body) such as polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-methyl α-chloroacrylate copolymer, and styrene-acrylonitrile-acrylate copolymer, as well as epoxy resins, vinyl chloride resins, rosin-modified maleic acid resins, phenol resins, polyethylene resins, polypropylene resins, petroleum resins, polyurethane resins, ketone resins, ethylene-ethyl acrylate copolymer, xylene resins, and polyvinyl butyrate resins. The production method of these resins is also not particularly limited, and any of bulk polymerization, solution polymerization, emulsion polymerization, and suspension polymerization can be employed.

In the present disclosure, the binder resin (resin for fixation) preferably includes a polyester resin. More preferably, the binder resin includes a polyester resin as a main component. Polyester resin is fixable at lower temperatures compared with other resins while maintaining heat-resistant storage stability. Therefore, polyester resin is suitable for the binder resin of the present disclosure.

The polyester resin used in the present disclosure is obtained by polycondensation of an alcohol with a carboxylic acid.

Specific examples of the alcohol include, but are not limited to, glycols such as ethylene glycol, diethylene glycol, triethylene glycol, and propylene glycol, etherified bisphenols such as 1,4-bis(hydroxymethyl)cyclohexane and bisphenol A, other divalent alcohol monomers, and trivalent or higher polyvalent alcohol monomers.

Specific examples of the carboxylic acid include, but are not limited to, divalent organic acid monomers such as maleic acid, fumaric acid, phthalic acid, isophthalic acid, terephthalic acid, succinic acid, and malonic acid, and trivalent or higher polyvalent carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl methylenecarboxypropane, and 1,2,7,8-octanetetracarboxylic acid.

Preferably, the polyester resin has a glass transition temperature (Tg) of from 50° C. to 75° C.

Charge Controlling Agent

The toner of the present disclosure may contain a charge controlling agent.

Examples of the charge controlling agent include, but are not limited to: nigrosine and modified products with fatty acid metal salts; onium salts such as phosphonium salt and lake pigments thereof; triphenylmethane dyes and lake pigments thereof; metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; organometallic complexes, chelate compounds, monoazo metal complexes, acetylacetone metal complexes, aromatic hydroxycarboxylic acids, metal complexes of aromatic dicarboxylic acids, and quaternary ammonium salts. Examples of the charge controlling agent further include aromatic hydroxycarboxylic acids, aromatic mono- and poly-carboxylic acids and metal salts, anhydrides, and esters thereof, and phenol derivatives such as bisphenol. Each of these materials can be used alone or in combination with others.

When the charge controlling agent is contained inside the toner, the amount thereof is preferably from 0.1 to 10 parts by mass based on 100 parts by mass of the binder resin. To prevent undesirable coloring of the toner, a transparent material is preferably selected for the charge controlling agent except for the case of black toner.

Inorganic Particles as External Additives

Examples of inorganic particles as external additives include, but are not limited to, silica, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these, silica, alumina, and titanium oxide are particularly preferred.

The inorganic particles may be those treated with a surface treatment agent such as a hydrophobizing agent. Preferred examples of the hydrophobizing agent include, but are not limited to, silane coupling agents, silylation agents, silane coupling agents having a fluorinated alkyl group, organic titanate coupling agents, and aluminum coupling agents. Also, silicone oils are also effective as the hydrophobizing agent.

The primary particles of the inorganic particles preferably have an average particle diameter of from 5 to 500 nm, more preferably from 5 to 200 nm. When the average particle diameter is 5 nm or more, the inorganic particles are less likely to aggregate and can be uniformly dispersed in the toner. When the average particle diameter is 500 nm or less, heat-resistant storage stability is improved due to a filler effect. Here, the average particle diameter is directly determined from a photograph of particles obtained with a transmission electron microscope. Preferably, the average particle diameter is the average value of long diameters of at least 100 or more particles observed.

Two-Component Developer

The toner of the present disclosure may be mixed with a carrier to provide a two-component developer, which is used for an electrophotographic image forming method employing a two-component developing system.

When a two-component developing system is employed, fine particles of a magnetic material can be used as a magnetic carrier. Specific examples of the magnetic materials include, but are not limited to: magnetites; spinel ferrites containing gamma iron oxide; spinel ferrites containing at least one metal (e.g., Mn, Ni, Zn, Mg, and Cu) other than iron; magnetoplumbite-type ferrites such as barium ferrite; and particulate iron or alloy having an oxidized layer on its surface. The magnetic material may be in any of granular, spherical, or needle-like shape. When high magnetization is required, ferromagnetic fine particles, such as iron, are preferably used. For chemical stability, magnetites, spinel ferrites containing gamma iron oxide, and magnetoplumbite-type ferrites such as barium ferrite are preferred.

Specific preferred examples thereof include, but are not limited to, commercially-available products such as MFL-35S and MFL-35H5 (manufactured by Powdertech Co., Ltd.); and DFC-400M, DFC-410M, and SM-350NV (manufactured by Dowa IP Creation Co., Ltd.).

A resin carrier may also be used which has a desired magnetization by containing an appropriate type of magnetic fine particles in an appropriate amount. Such a resin carrier preferably has a magnetization strength of from 30 to 150 emu/g at 1,000 oersted. Such a resin carrier in which magnetic fine particles are dispersed in a binder resin may be produced by spraying a melt-kneaded product of the magnetic fine particles with an insulating binder resin by a spray dryer, or causing a monomer or prepolymer to react or cure in an aqueous medium in the presence of the magnetic fine particles.

Chargeability of the magnetic carrier may be controlled by fixedly adhering positively- or negatively-chargeable fine particles or conductive fine particles to the surface of the magnetic carrier, or coating the magnetic carrier with a resin.

Examples of the surface coating resin include, but are not limited to, silicone resin, acrylic resin, epoxy resin, and fluorine-based resin. These resins may contain positively- or negatively-chargeable fine particles or conductive fine particles. Among these resins, silicone resin and acrylic resin are preferred.

Preferably, a mass ratio of the carrier in the two-component developer accommodated in a developing device is 85% by mass or higher but less than 98% by mass. When the mass ratio is 85% by mass or higher, the toner is prevented from scattering from the developing device, thereby preventing the occurrence of defective images. When the mass ratio of the carrier in the developer is less than 98% by mass, an excessive increase of the charge amount of the toner and shortage of the toner to be supplied can be prevented, thereby effectively preventing a decrease of image density and the occurrence of defective images.

Method of Manufacturing Toner

The toner of the present disclosure may be prepared as follows. First, a binder resin, a colorant, and a release agent, optionally together with a charge controlling agent, are well mixed by a mixer such as HENSCHEL MIXER and SUPER MIXER. The mixture is then melt-kneaded by a heat melt kneader such as a heat roll, a kneader, and an extruder, so that the materials are thoroughly mixed. The kneaded mixture is cooled to solidify, then pulverized into fine particles, and the fine particles are classified by size to obtain a toner. The pulverizing process may be of a jet mill process in which a high-speed airflow incorporates toner particles to let the toner particles collide with a collision plate and be pulverized by the collision energy, an inter-particle collision process which lets toner particles collide with each other in an airflow, or a mechanical pulverizing process in which toner particles are supplied to a narrow gap formed with a rotor rotating at a high speed to be pulverized.

The toner of the present disclosure may also be prepared by a dissolution suspension method. In this method, an oil phase is dispersed in an aqueous medium. Here, the oil phase comprises an organic solvent and toner materials dissolved or dispersed therein. After a reaction for forming a resin is conducted, removal of the solvent, filtration, washing, and drying are conducted, thus obtaining toner base particles.

Image Forming Apparatus and Image Forming Method

Next, an image forming apparatus and an image forming method according to some embodiments of the present invention are described in detail below.

An image forming apparatus according to an embodiment of the present invention includes: an electrostatic latent image bearer; an electrostatic latent image forming device configured to form an electrostatic latent image on the electrostatic latent image bearer; a developing device accommodating a developer containing a toner, configured to develop the electrostatic latent image on the electrostatic latent image bearer with the developer to form a toner image; a transfer device configured to transfer the toner image from the electrostatic latent image bearer onto a recording medium (resin film); and a fixing device configured to fix the toner image on the recording medium. Here, the toner contains a maleic-acid-modified polyolefin having a polypropylene block in the main chain. This image forming apparatus contains four developing devices respectively accommodating black toner, yellow toner, cyan toner, and magenta toner and forms full-color images. The image forming apparatus may contain five or more developing devices to further accommodate white toner, colorless toner, or special color toner.

An image forming method according to an embodiment of the present invention includes: forming an electrostatic latent image on an electrostatic latent image bearer; developing the electrostatic latent image on the electrostatic latent image bearer with a developer containing a toner to form a toner image; transferring the toner image from the electrostatic latent image bearer onto a recording medium; and fixing the toner image on the recording medium. Here, the toner contains a maleic-acid-modified polyolefin having a polypropylene block in the main chain.

The image forming apparatus according to an embodiment of the present invention is described below with reference to FIG. 1.

Hereinafter, embodiments of the present invention are described in detail with reference to the drawings.

FIG. 1 is a schematic diagram of an image forming apparatus according to an embodiment of the present invention.

An image forming apparatus 1 illustrated in FIG. 1 is a color image forming apparatus including a tandem image forming device (also referred to as image forming device or process cartridge) that forms a color image. Specifically, the image forming apparatus 1 includes an image forming device 11, a sheet feeder 12, a transfer device 13, a fixing device 14, and a processor 16.

Image Forming Device 11

The image forming device 11 includes four image forming units 110Y, 110M, 110C, and 110K that form toner images of yellow (Y), magenta (M), cyan (C), and black (K), respectively.

The four image forming units 110Y, 110M, 110C, and 110K have the same configuration except for accommodating different color toners of Y, M, C, and K, respectively, as image forming materials, and are replaceable when their lifespans are over. The image forming units 110Y, 110M, 110C, and 110K are detachably attached to an apparatus body 2 and constitute a process cartridge. Hereinafter, the common configuration is described with reference to the image forming unit 110K for forming a K toner image as an example.

The image forming unit 110K includes a charging device 111K, a photoconductor 112K as a K toner image bearer for bearing a K toner image on the surface thereof, a developing device 114K, a charge removing device 115K, and a photoconductor cleaning device 116K. These devices are held by a common holder that is detachably attached to the apparatus body 2, so that these devices are replaceable at the same time.

The photoconductor 112K has a drum-like shape and includes a substrate and an organic photosensitive layer formed on the surface of the substrate. The photoconductor 112K is rotationally driven counterclockwise by a driver. In the charging device 111K, a charger applies a charging bias to a charging wire that is a charging electrode of the charger to generate an electrical discharge between the charging wire and the outer peripheral surface of the photoconductor 112K, thus uniformly charging the surface of the photoconductor 112K. In the present embodiment, the photoconductor 112K is charged to the negative polarity that is the same as the charging polarity of the toner. The charging bias employed in the present embodiment is one in which an alternating current voltage is superimposed on a direct current voltage. In place of the charger, a charging roller may be disposed in contact with or in proximity to the photoconductor 112K.

The uniformly-charged surface of the photoconductor 112K is then optically scanned by laser light emitted from an exposure device 113, to be described later, thus forming an electrostatic latent image for K. Of the entire area of the uniformly-charged surface of the photoconductor 112K, the potential is attenuated at the portion irradiated with the laser light. Thus, the portion irradiated with the laser light becomes an electrostatic latent image having a potential smaller than the potential at the other portion (background portion). The electrostatic latent image for K is developed into a K toner image by the developing device 114K accommodating K toner, to be described later. The K toner image is then primarily transferred onto an intermediate transfer belt 131, to be described later.

The developing device 114K includes a container in which a two-component developer containing K toner and a carrier are accommodated. The container is internally provided with a developing sleeve, and the developer is carried on the surface of the developing sleeve by the magnetic force of a magnet roller provided inside the developing sleeve. The developing sleeve is applied with a developing bias which has the same polarity as the toner and is larger than the potential of the electrostatic latent image on the photoconductor 112K and smaller than the charging potential of the photoconductor 112K. Between the developing sleeve and the electrostatic latent image on the photoconductor 112K, a developing potential acts from the developing sleeve toward the electrostatic latent image. Further, between the developing sleeve and the background portion of the photoconductor 112K, a non-developing potential acts that causes the toner on the developing sleeve to move toward the surface of the sleeve. By the actions of the developing potential and the non-developing potential, the K toner on the developing sleeve is selectively attached to the electrostatic latent image on the photoconductor 112K, thereby developing the electrostatic latent image into a K toner image on the photoconductor 112K.

The charge removing device 115K removes the charge on the surface of the photoconductor 112K after the toner image has been primarily transferred onto the intermediate transfer belt 131. The photoconductor cleaning device 116K includes a cleaning blade and a cleaning brush and removes residual untransferred toner remaining on the surface of the photoconductor 112K that has been neutralized by the charge removing device 115K.

The other image forming units 110Y 110M, and 110C in FIG. 1 have the same configuration. Therefore, Y, M, and C toner images are formed on the respective photoconductors 112Y, 112M, and 112C in the respective image forming units 110Y, 110M, and 110C in the same manner as in the image forming unit 110K.

Above the image forming units 110Y, 110M, 110C, and 110K, the exposure device 113 is disposed as a latent image writing device or an exposure device. The exposure device 113 optically scans the photoconductors 112Y, 112M, 112C, and 112K with laser light emitted from a laser diode based on image information transmitted from an external device such as a personal computer.

The exposure device 113 emits laser light from a light source to the photoconductors 112Y, 112M, 112C, and 112K via a plurality of optical lenses and mirrors while polarizing the laser light in the main scanning direction by a polygon mirror that is rotationally driven by a polygon motor. In place of the laser light, LED light emitted from a plurality of light emitting diodes (LEDs) may be employed for optical writing.

Sheet Feeder 12

The sheet feeder 12 supplies a sheet as the recording medium to the transfer device 13. The sheet feeder 12 includes a resin film roll 121, pairs of guide rollers 122, and a resin film winding roll 123. The resin film roll 121 sends out a resin film. The guide rollers 122 control the conveyance speed, meandering motion, and tension of the resin film. The resin film on which a toner image has been transferred and fixed is wound up by the resin film winding roll 123.

Transfer Device 13

The transfer device 13 is disposed below the image forming units 110Y, 110M, 110C, and 110K. The transfer device 13 includes a driving roller 132, a driven roller 133, the intermediate transfer belt 131, primary transfer rollers 134Y, 134M, 134C, and 134K, a secondary transfer roller 135, a secondary transfer facing roller 136, a toner deposition amount sensor 137, and a belt cleaning device 138.

The intermediate transfer belt 131 functions as an endless intermediate transferor (also referred to as an intermediate image bearer). The intermediate transfer belt 131 is stretched by the driving roller 132, the driven roller 133, the secondary transfer facing roller 136, and the primary transfer rollers 134Y, 134M, 134C, and 134K, all of which are disposed inside the loop thereof. The term "disposed" is here used to mean "provided with an arrangement" or "provided to a specific position". The term "stretched" is here used to mean "stretched over under tension".

The driving roller 132 is rotationally driven clockwise in the drawing by a driver, so that the intermediate transfer belt 131 endlessly moves and travels in the same direction in contact with the photoconductors 112Y, 112M, 112C, and 112K.

The intermediate transfer belt 131 has a thickness of from 20 to 200 μm, preferably about 60 μm. The intermediate transfer belt 131 is preferably comprised of a resin dispersing a carbon having a volume resistivity of from $1\times10^{6}$ to $1\times10^{12}$ Ω·cm, preferably about $1\times10^{9}$ Ω·cm, measured by an instrument HIRESTA UP MCP HT 45 manufactured by Mitsubishi Chemical Analytech Co., Ltd. (now Nittoseiko Analytech Co., Ltd.) under an applied voltage of 100 V.

The toner deposition amount sensor 137 is disposed in the vicinity of the intermediate transfer belt 131 that is wound around the driving roller 132. The toner deposition amount sensor 137 functions as a toner amount detector that detects the amount of the toner transferred onto the intermediate transfer belt 131. The toner deposition amount sensor 137 is a light reflection photosensor. The toner deposition amount sensor 137 measures the amount of toner deposition by detecting the amount of light reflected from the toner image deposited and formed on the intermediate transfer belt 131. The toner deposition amount sensor 137 may also function as a toner concentration sensor as a generally-used toner concentration detector that detects and measures the toner concentration. In such a case, there is no need to arrange another toner amount detector, so that the number of parts can be reduced to contribute to cost reduction. Alternatively, the toner deposition amount sensor 137 may be disposed at a position where the toner image on the photoconductor 112 can be detected, in place of the position facing the intermediate transfer belt 131.

The primary transfer rollers 134Y, 134M, 134C, and 134K are disposed facing the respective photoconductors 112Y, 112M, 112C, and 112K with the intermediate transfer belt 131 interposed therebetween, and are driven to rotate so as to move the intermediate transfer belt 131. As a result, the front surface of the intermediate transfer belt 131 come into contact (or abutment) with the photoconductors 112Y, 112M, 112C, and 112K to form primary transfer nips. Each of the primary transfer rollers 134Y, 134M, 134C, and 134K is applied with a primary transfer bias by a primary transfer bias power supply. Thus, the primary transfer bias is established between the Y, M, C, and K toner images on the respective photoconductors 112Y, 112M, 112C, and 112K and the respective primary transfer rollers 134Y, 134M, 134C, and 134K. The color toner images are then sequentially transferred onto the intermediate transfer belt 131.

The Y toner image formed on the surface of the photoconductor 112Y enters the primary transfer nip for Y as the photoconductor 112Y rotates. The Y toner image is then primarily transferred from the photoconductor 112Y onto the intermediate transfer belt 131 due to the action of the transfer bias and the nip pressure. The intermediate transfer belt 131 onto which the Y toner image has been primarily transferred then sequentially passes the primary transfer nips for M, C, and K. Next, the M, C, and K toner images on the respective photoconductors 112M, 112C, and 112K are sequentially primarily transferred onto the Y toner image in an overlapping manner. As a result of the primary transfer in an overlapping manner, a full-color toner image is formed on the intermediate transfer belt 131.

Each of the primary transfer rollers 134Y, 134M, 134C, and 134K is an elastic roller comprised of a core metal and a conductive sponge layer fixed on the surface of the core metal. The elastic roller has an outer diameter of 16 mm and the core metal has a diameter of 10 mm. The resistance value R of the sponge layer was calculated from the current I that flows upon application of a voltage of 1,000 V to the core metal of each of the primary transfer rollers 134Y, 134M, 134C, and 134K with the sponge layer pressed by a grounded metal roller having an outer diameter of 30 mm with a force of 10 N.

Specifically, the resistance value R of the sponge layer calculated based on the Ohm's law (R=V/I) from the current I that flows upon application of a voltage of 1,000 V to the core metal is about $3\times10^7\Omega$. Each of the primary transfer rollers 134Y, 134M, 134C, and 134K is then applied with a primary transfer bias output from the primary transfer bias power supply under a constant current control. In place of the primary transfer rollers 134Y, 134M, 134C, and 134K, a transfer charger or a transfer brush may be employed.

The secondary transfer roller 135 is rotationally driven by a driver, with the intermediate transfer belt 131 and the continuous resin film sandwiched between the secondary transfer roller 135 and the secondary transfer facing roller 136. The secondary transfer roller 135 is in contact with the front surface of the intermediate transfer belt 131 to form a secondary transfer nip 139 as a transfer nip. The secondary transfer roller 135 also functions as a nip forming member and a transfer member that transfers a toner image from the intermediate transfer belt onto the sheet as a recording medium sandwiched in the secondary transfer nip. The secondary transfer facing roller 136 functions as a nip forming member and a facing member. While the secondary transfer roller 135 is grounded, the secondary transfer facing roller 136 is applied with a secondary transfer bias by a secondary transfer bias power supply 130.

The secondary transfer bias power supply 130 includes both a direct-current power supply and an alternating-current power supply, and is able to output a direct-current voltage superimposed with an alternating-current voltage as the secondary transfer bias. The output terminal of the secondary transfer bias power supply 130 is connected to the core metal of the secondary transfer facing roller 136. The potential of the core metal of the secondary transfer facing roller 136 is substantially the same as the voltage output from the secondary transfer bias power supply 130.

As the secondary transfer bias is applied to the secondary transfer facing roller 136, a secondary transfer bias is formed between the secondary transfer facing roller 136 and the secondary transfer roller 135 that electrostatically moves the toner having the negative polarity from the secondary transfer facing roller 136 side toward the secondary transfer roller 135 side. As a result, the toner having the negative polarity on the intermediate transfer belt 131 can be moved from the secondary transfer facing roller 136 side to the secondary transfer roller 135 side.

The secondary transfer bias power supply 130 uses a direct-current component which has the same negative polarity as the toner and makes the time-averaged potential of the superimposition bias the same negative polarity as the toner. Here, instead of grounding the secondary transfer roller 135 while applying the superimposition bias to the secondary transfer facing roller 136, the core metal of the secondary transfer facing roller 136 may be grounded while applying the superimposition bias to the secondary transfer roller 135. In this case, the polarities of the direct-current voltage and the direct-current component are made different.

The secondary transfer facing roller 136 is comprised of a core metal made of stainless steel, aluminum, or the like, and a resistance layer stacked thereon. The secondary transfer facing roller 136 may have an outer diameter of about 24 mm. The diameter of the core metal is about 16 mm. The resistance layer may be comprised of a polycarbonate, fluorine-based rubber, or silicon-based rubber in which conductive particles such as carbon and a metal complex are dispersed, a rubber such as NBR (nitrile rubber) and EPDM (ethylene-propylene-diene monomer), a rubber of NBR/ECO (epichlorohydrin rubber) copolymer, or a semiconducting rubber made of polyurethane. The volume resistance of the resistance layer is from $10^6$ to $10^{12}\Omega$, preferably from $10^7$ to $10^9\Omega$. Either foamed types having a rubber hardness (ASKER-C) of from 20 to 50 degrees or rubber types having a rubber hardness (ASKER-C) of from 30 to 60 degrees may be used. In particular, since the resistance layer contacts the secondary transfer roller 135 via the intermediate transfer belt 131, sponge types that do not produce non-contact portions even with a small contact pressure are preferable.

On the intermediate transfer belt 131 that has passed through the secondary transfer nip after the secondary transfer, residual toner that has not been transferred onto the resin film is remaining. The residual toner is removed from the surface of the intermediate transfer belt 131 by the belt cleaning device 138 provided with a cleaning blade that is in contact with the surface of the intermediate transfer belt 131.

Fixing Device 14

The fixing device 14 employs a belt fixing system and is configured with a fixing belt 141 that is an endless belt and a pressure roller 142 pressed against the fixing belt 141. The fixing belt 141 is wound around a fixing roller 143 and a heating roller 144, and at least one of the rollers is provided with a heat source or heater (e.g., heater, lamp, electromagnetic induction heater). The fixing belt 141 is nipped and pressed between the fixing roller 143 and the pressure roller 142, thus forming a fixing nip between the fixing belt 141 and the pressure roller 142.

The resin film fed into the fixing device 14 is nipped by the fixing nip with the surface thereof bearing an unfixed toner image in close contact with the fixing belt 141. The toner in the toner image is then softened by heat and pressure, thus fixing the toner image. The resin film having the toner image thereon is ejected outside the apparatus.

The toner of the present disclosure has good adhesiveness to the resin film. The resin film exhibits high adhesive force to the fixing belt 141 and the toner. It is likely that the cut resin film gets wrapped around the fixing belt 141. Especially when the resin film is thin and loosely cut, wrapping is more likely to occur. Therefore, in the present embodiment illustrated in FIG. 1, a continuous resin film is used and, when coming out of the fixing device, applied with tension in the traveling direction to prevent the resin film from wrapping around the fixing belt.

Toner Accommodating Unit

In the present disclosure, a toner accommodating unit refers to a unit having a function of accommodating toner and accommodating the toner. The toner accommodating unit may be in the form of, for example, a toner accommodating container, a developing device, or a process cartridge.

The toner accommodating container refers to a container accommodating the toner.

The developing device refers to a device that accommodates toner and is configured to develop an electrostatic latent image into a toner image with the toner.

The process cartridge refers to a combined body of an image bearer with a developing unit accommodating the toner, detachably mountable on an image forming apparatus. The process cartridge may further include at least one of a charger, an irradiator, and a cleaner.

When the toner accommodating unit of the present disclosure is mounted on the image forming apparatus of the present disclosure, an image is formed with the toner of the present disclosure, providing a toner image having a high degree of adhesiveness to films, which has not been achieved with conventional process color toners.

Recording Medium

In the present disclosure, a continuous resin film is used as a recording medium. Specific examples of the resin film include, but are not limited to, polyethylene film, polypropylene film, polyethylene terephthalate film, vinyl chloride resin film, polystyrene film, acrylic film, polycarbonate film, polyphenylene sulfide film, fluororesin film, polyetheretherketone film, polyethersulfone film, aramid film, polyimide film, and tri acetate film. The above-described recording media whose surfaces are coated with a different material are also preferred. The thickness of the resin film can be suitably selected, but is preferably from 20 to 1,000 μm. More preferably, the thickness is from 30 to 100 μm. When the thickness of the film is 20 μm or more, the strength of the film can be maintained. When the thickness is 30 μm or more, the strength is sufficient. When the thickness of the film is 1,000 μm or less, the resin film can be deformed to some extent and passed though the image forming device for printing. When the thickness is 100 μm or less, the resin film is further provided with flexibility and becomes suitable for packaging foods and the like.

Examples

Having generally described this invention, further understanding can be obtained by reference to certain specific examples which are provided herein for the purpose of illustration only and are not intended to be limiting. "Parts" represents parts by mass and "percent" represents percent by mass unless otherwise specified in the following description.

Production of Master Batch

Production of Yellow Master Batch

Polyester resin EXL-101 (manufactured by Sanyo Chemical Industries, Ltd.): 100 parts Pigment Yellow 185 (PAIOTOL YELLOW D1155, manufactured by BASF): 100 parts Pure water: 50 parts The raw materials listed above were preliminarily mixed using a HENSCHEL MIXER (FM20B manufactured by NIPPON COKE & ENGINEERING CO., LTD.) and kneaded for 1 hour using a double roll having a surface temperature of 110° C. The kneaded product was cooled to room temperature and coarsely pulverized using a ROTOPLEX to have a diameter of from 200 to 300 μm. Thus, a yellow master batch was prepared.

Production of Cyan Master Batch

Polyester resin EXL-101 (manufactured by Sanyo Chemical Industries, Ltd.): 100 parts Copper phthalocyanine pigment (CYANINE BLUE 4920, manufactured by Dainichiseika Color & Chemicals Mfg. Co., Ltd.): 100 parts Pure water: 50 parts The raw materials listed above were preliminarily mixed using a HENSCHEL MIXER (FM20B manufactured by NIPPON COKE & ENGINEERING CO., LTD.) and kneaded for 1 hour using a double roll having a surface temperature of 110° C. The kneaded product was cooled to room temperature and coarsely pulverized using a ROTOPLEX to have a diameter of from 200 to 300 μm. Thus, a cyan master batch was prepared.

Production of Magenta Master Batch

Polyester resin EXL-101 (manufactured by Sanyo Chemical Industries, Ltd.): 100 parts Pigment Red 122 (FASTOAGEN® SUPER MAGENTA R, manufactured by DIC Corporation): 100 parts Pure water: 50 parts The raw materials listed above were preliminarily mixed using a HENSCHEL MIXER (FM20B manufactured by NIPPON COKE & ENGINEERING CO., LTD.) and kneaded for 1 hour using a double roll having a surface temperature of 110° C. The kneaded product was cooled to room temperature and coarsely pulverized using a ROTOPLEX to have a diameter of from 200 to 300 μm. Thus, a magenta master batch was prepared.

Production of Black Master Batch

Polyester resin EXL-101 (manufactured by Sanyo Chemical Industries, Ltd.): 100 parts Carbon black (NIPEX 60, manufactured by Orion Engineered Carbons): 90 parts Copper phthalocyanine pigment (CYANINE BLUE 4920, manufactured by Dainichiseika Color & Chemicals Mfg. Co., Ltd.): 10 parts Pure water: 50 parts The raw materials listed above were preliminarily mixed using a HENSCHEL MIXER (FM20B manufactured by NIPPON COKE & ENGINEERING CO., LTD.) and kneaded for 1 hour using a double roll having a surface temperature of 110° C. The kneaded product was cooled to room temperature and coarsely pulverized using a ROTOPLEX to have a diameter of from 200 to 300 μm. Thus, a black master batch was prepared.

Production of Toner Set 1

Production of Yellow Toner 1

Polyester resin EXL-101 (manufactured by Sanyo Chemical Industries, Ltd.): 67 parts Polyester resin RN-290 (manufactured by Kao Corporation): 20 parts Ester wax WEP-3 (manufactured by NOF CORPORATION): 5 parts Yellow master batch: 12 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 2 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 6.2±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 7.0±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a yellow toner 1 was prepared.

Production of Cyan Toner 1

Polyester resin EXL-101 (manufactured by Sanyo Chemical Industries, Ltd.): 67 parts Polyester resin RN-290 (manufactured by Kao Corporation): 20 parts Ester wax WEP-3 (manufactured by NOF CORPORATION): 5 parts Cyan master batch: 12 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 2 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 6.2±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 7.0±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a cyan toner 1 was prepared.

Production of Magenta Toner 1

Polyester resin EXL-101 (manufactured by Sanyo Chemical Industries, Ltd.): 67 parts Polyester resin RN-290 (manufactured by Kao Corporation): 20 parts Ester wax WEP-3 (manufactured by NOF CORPORATION): 5 parts Magenta master batch: 12 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 2 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 6.2±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 7.0±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a magenta toner 1 was prepared.

Production of Black Toner 1

Polyester resin EXL-101 (manufactured by Sanyo Chemical Industries, Ltd.): 67 parts Polyester resin RN-290 (manufactured by Kao Corporation): 20 parts Ester wax WEP-3 (manufactured by NOF CORPORATION): 5 parts Black master batch: 12 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 2 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 6.2±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 7.0±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a black toner 1 was prepared.

The above-prepared four toners, i.e., yellow toner 1, cyan toner 1, magenta toner 1, and black toner 1, were used as a toner set 1.

Production of Toner Set 2

Production of Yellow Toner 2

Polyester resin EXL-101 (manufactured by Sanyo Chemical Industries, Ltd.): 55 parts Polyester resin RN-290 (manufactured by Kao Corporation): 20 parts Ester wax WEP-3 (manufactured by NOF CORPORATION): 5 parts Yellow master batch: 30 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 5 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 3.4±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 4.2±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a yellow toner 2 was prepared.

Production of Cyan Toner 2

Polyester resin EXL-101 (manufactured by Sanyo Chemical Industries, Ltd.): 55 parts Polyester resin RN-290 (manufactured by Kao Corporation): 20 parts Ester wax WEP-3 (manufactured by NOF CORPORATION): 5 parts Cyan master batch: 30 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 5 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 3.4±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 4.2±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a cyan toner 2 was prepared.

Production of Magenta Toner 2

Polyester resin EXL-101 (manufactured by Sanyo Chemical Industries, Ltd.): 55 parts Polyester resin RN-290 (manufactured by Kao Corporation): 20 parts Ester wax WEP-3 (manufactured by NOF CORPORATION): 5 parts Magenta master batch: 30 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 5 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 3.4±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 4.2±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a magenta toner 2 was prepared.

Production of Black Toner 2

Polyester resin EXL-101 (manufactured by Sanyo Chemical Industries, Ltd.): 55 parts Polyester resin RN-290 (manufactured by Kao Corporation): 20 parts Ester wax WEP-3 (manufactured by NOF CORPORATION): 5 parts Black master batch: 30 parts Maleic-acid-modified polyolefin having a polypropylene block in the main chain TOYOTAC-F7 (manufactured by TOYOBO CO., LTD., having a ½ outflow temperature of 125° C., a weight average molecular weight of 90,000, and a maleic acid modification rate of 1.1%): 5 parts The toner raw materials listed above were preliminarily mixed by a HENSCHEL MIXER (FM20B manufactured by NIPPON COKE & ENGINEERING CO., LTD.) and melt-kneaded by a single-shaft kneader (BUSS CO-KNEADER manufactured by Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 3.4±0.3 μm by a COUNTER JET MILL (100AFG manufactured by Hosokawa Micron Corporation) while appropriately adjusting the pulverization air pressure. The fine particles were classified by size using an air classifier (EJ-LABO manufactured by MATSUBO Corporation) while appropriately adjusting the opening of the louver such that the weight average particle diameter became 4.2±0.2 μm and the ratio of weight average particle diameter to number average particle diameter became 1.20 or less. Thus, toner base particles were prepared. Next, 100 parts of the toner base particles were stir-mixed with additives including 1.0 part of a hydrophobic silica HDK-2000 and 1.0 part of a hydrophobic silica H05TD, both manufactured by Clariant AG, by a HENSCHEL MIXER. Thus, a black toner 2 was prepared.

The above-prepared four toners, i.e., yellow toner 2, cyan toner 2, magenta toner 2, and black toner 2, were used as a toner set 2.

Production of Toner Sets 3 to 14

The toner sets 3 to 14 were prepared in the same manner as the toner sets 1 to 2.

The composition of toner raw materials and the weight average diameter of toner are shown in Table 1.

In Table 1, numerical values showing the blending amount of pigment are shown. In the master batch, the ratio between the pigment and the polyester resin EXL-101 is 1:1. Therefore, the amount of master batch becomes twice the amount of pigment. The amount of the polyester resin EXL-101 blended in the toner manufacturing process is that obtained by subtracting the amount of pigment from the amount of the polyester resin EXL-101 shown in Table 1.

The weight average particle diameter of toners with a high pigment content was adjusted to as small as 4.2±0.2 μm. This is because a high image density can be achieved with a small amount of toner deposition. To obtain a uniform image with a small amount of toner deposition, the particle diameter is adjusted to be small.

The materials shown in Table 1 are described below.

Maleic-acid-modified Polyolefin Having Polypropylene Block in Main Chain

TOYOTAC-H3000P (manufactured by TOYOBO CO., LTD.), having a ½ outflow temperature of 137° C., a weight average molecular weight of 200,000, and a maleic acid modification rate of 5.5%

TOYOTAC-T (manufactured by TOYOBO CO., LTD.), having a ½ outflow temperature of 95° C., a weight average molecular weight of 75,000, and a maleic acid modification rate of 1.5%

TOYOTAC-KH (manufactured by TOYOBO CO., LTD.), having a ½ outflow temperature of 80° C., a weight average molecular weight of 90,000, and a maleic acid modification rate of 1.1%

TOYOTAC-TE (manufactured by TOYOBO CO., LTD.), having a ½ outflow temperature of 95° C., a weight average molecular weight of 60,000, and a maleic acid modification rate of 2.0% Paraffin Wax HNP-9 (manufactured by NIPPON SEIRO CO., LTD.)

Note that "TOYOTAC-F7", "TOYOTAC-H3000P", "TOYOTAC-T", "TOYOTAC-KH", and "TOYOTAC-TE" each, used as the maleic-acid-modified polyolefin having a polypropylene block in the main chain, contain a polyethylene block and a polybutene block.

Production of Two-Component Developer

Preparation of Carrier

Silicone resin (Organo straight silicone): 100 parts

Toluene: 100 parts

γ-(2-Aminoethyl) aminopropyl trimethoxysilane: 5 parts

Carbon black: 10 parts

The above materials were dispersed by a homomixer for 20 minutes to prepare a coating layer forming liquid. Manganese (Mn) ferrite particles having a weight average particle diameter of 35 μm as core materials were coated with the coating layer forming liquid using a fluidized bed coating device while controlling the temperature inside the fluidized bed to 70° C., followed by drying, so that the coating layer was formed on the surface of the core materials with an average film thickness of 0.20 μm. The core materials having the coating layer were burnt in an electric furnace at 180° C. for 2 hours. Thus, a carrier A was prepared.

Preparation of Two-Component Developer

Each toner was uniformly mixed with the carrier A by a TURBULA MIXER (manufactured by Willy A. Bachofen AG (WAB)) at a revolution of 48 rpm for 5 minutes to be charged. Thus, each two-component developer was prepared. The mixing ratio of the toner to the carrier was 7% by mass, which was equal to the initial toner concentration in the developer of a test machine.

The test machine was a RICOH Pro C7200S (manufactured by Ricoh Co., Ltd.) which has been modified to be able to use a continuous resin film in printing.

Each toner of the toner sets 1 to 14 and two-component developer thereof were set in the test machine RICOH Pro C7200S (manufactured by Ricoh Co., Ltd.) to make prints on the resin film. The development and transfer conditions were adjusted by a process controller such that the single-color toner deposition amount became 0.40 mg/cm$^2$ or 0.20 mg/cm$^2$ for toners having a weight average particle diameter of 7.0±0.2 μm or 4.2±0.2 μm, respectively.

A solid image having a 5-cm length in the resin film advancing direction and a 25-cm length in the lateral direction with respect to the resin film advancing direction was formed every 5 cm in the resin film advancing direction. The order of solid images is as follows: yellow image, cyan image, magenta image, black image, green image (in which yellow toner and cyan toner are superimposed), blue image (in which magenta toner and cyan toner are superimposed), and red image (in which yellow toner and magenta toner are superimposed).

As the continuous resin film, a PP (polypropylene) resin film having a surface coating with a styrene-acryl resin and a thickness of 50 μm and a PET (polyethylene terephthalate) film having a thickness of 50 μm were used.

Images were obtained at fixing temperatures varied in the range of from 130° C. to 200° C. in steps of 5° C. by the process controller and evaluated to determine the lowest fixable temperature.

Drawing Fixing Temperature

Figure 2:
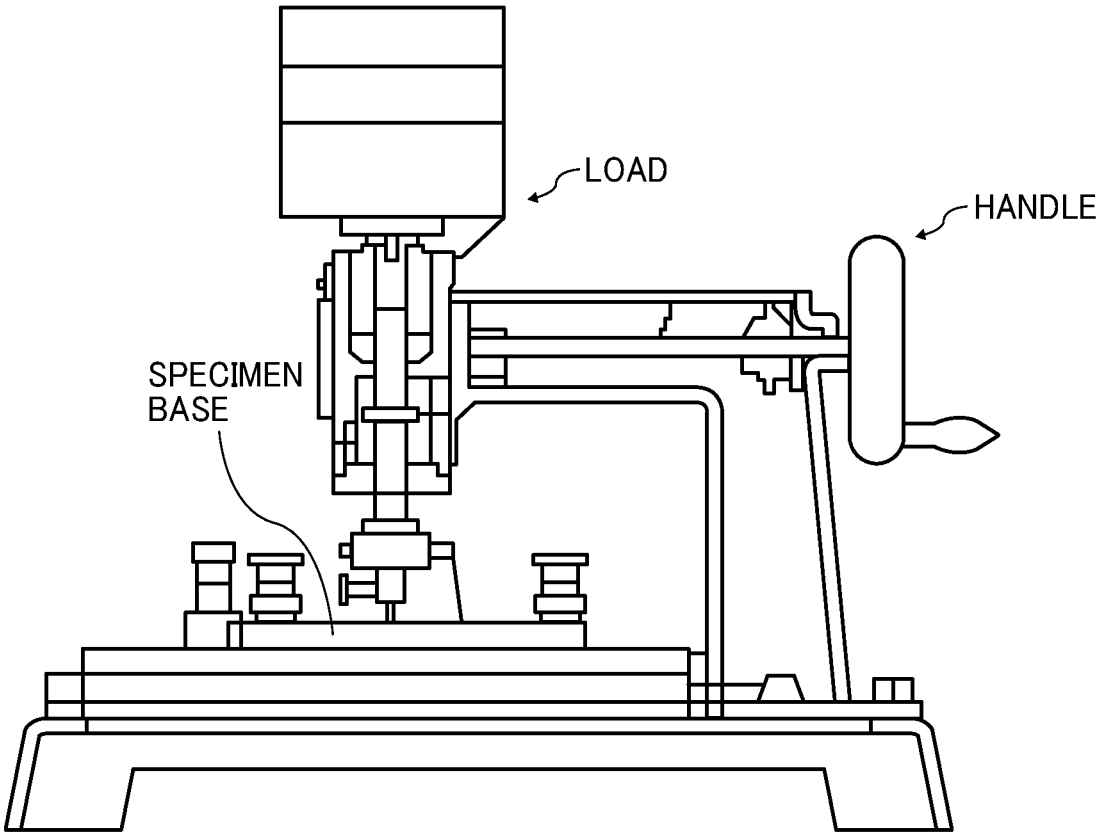
FIG. 2 is an illustration of a drawing tester capable of pressing a needle against a sample, used for an evaluation of fixing strength.

The fixed image was placed on a specimen base of a drawing tester illustrated in FIG. 2, and the needle was pressed against the specimen with application of a load of 50 g. The handle was rotated about 5 times in one direction at a speed of about 1 to 2 times/sec. After the drawing test, the image was rubbed strongly with sponge waste cloth or the like about 3 times in a reciprocated manner, and the scraped toner was removed. A case in which the background was not exposed even with the drawing marks was judge to be OK. The lowest temperature at which the result of the drawing test was OK was determined as the drawing fixing temperature.

Tape Peeling Fixing Temperature

A piece of mending tape (manufactured by Sumitomo 3M Limited) was attached to the obtained fixed image, and a 500-g cylindrical weight (having a diameter of 3 cm) was placed thereon with its bottom face downward, so that the tape sufficiently got adhered to the fixed image. After that, the mending tape was slowly peeled off from the fixed image. The image density of the fixed image before the tape had been attached and after the tape had been peeled off was measured using an image densitometer GRETAG SPM50 (manufactured by GretagMacbeth). The measurement was performed at three points in the image portion, and the average value was calculated as the image density. The fixing rate (%) was calculated from the following formula: (image density after peeling/image density before peeling)×100. The temperature at which the fixing rate became 90% or more was defined as the tape peeling fixing temperature.

Film Curling Evaluation

Film curling was evaluated with the image fixed at a temperature 5° C. high than the drawing fixing temperature or the tape peeling fixing temperature whichever was higher.

Evaluation Criteria

A: Film curling has not occurred.

B: Film curling has slightly occurred.

C: Film curling has not occurred.

The evaluation results are shown in Table 2.

In Comparative Example 1 and Comparative Example 2, the toner did not get fixed on the resin film at the fixing temperature of 200° C. Therefore, the film curling test was not performed.

TABLE 1

| | | Ex. 1 | Ex. 2 | Ex. 3 | Ex. 4 | Ex. 5 | Ex. 6 | Ex. 7 |
|---|---|---|---|---|---|---|---|---|
| Toner Set | | Set 1 | Set 2 | Set 3 | Set 4 | Set 5 | Set 6 | Set 7 |
| Polyester Resin (EXL-101) | (parts by mass) | 73 | 70 | 57 | 70 | 70 | 70 | 70 |
| Polyester Resin (RN-290) | (parts by mass) | 20 | 20 | 20 | 20 | 20 | 20 | 20 |
| TOYOTAC-F7 | (parts by mass) | 2 | 5 | 18 | | | | |
| TOYOTAC-H3000P | (parts by mass) | | | | 5 | | | |
| TOYOTAC-T | (parts by mass) | | | | | 5 | | |
| TOYOTAC-KH | (parts by mass) | | | | | | 5 | |
| TOYOTAC-TE | (parts by mass) | | | | | | | 5 |
| Ester Wax (WEP-3) | (parts by mass) | 5 | 5 | 5 | 5 | 5 | 5 | 5 |
| Paraffin Wax (HNP-9) | (parts by mass) | | | | | | | |
| Pigment (YMCK) | (parts by mass) | 6 | 15 | 15 | 15 | 15 | 15 | 15 |
| Pigment Content in Toner * | | 5.5% | 12.8% | 12.8% | 12.8% | 12.8% | 12.8% | 12.8% |
| Weight Average Particle Diameter of Toner | [μm] | 7.0 ± 0.2 | 4.2 ± 0.2 | 4.2 ± 0.2 | 4.2 ± 0.2 | 4.2 ± 0.2 | 4.2 ± 0.2 | 4.2 ± 0.2 |

| | | Ex. 8 | Ex. 9 | Ex. 10 | Ex. 11 | Ex. 12 | Comp. Ex. 1 | Comp. Ex. 2 |
|---|---|---|---|---|---|---|---|---|
| Toner Set | | Set 8 | Set 9 | Set 10 | Set 11 | Set 12 | Set 13 | Set 14 |
| Polyester Resin (EXL-101) | (parts by mass) | 70 | 70 | 70 | 74.5 | 53 | 75 | 75 |
| Polyester Resin (RN-290) | (parts by mass) | 20 | 20 | 20 | 20 | 20 | 20 | 20 |

TABLE 1-continued

| | | | | | | | | |
|---|---|---|---|---|---|---|---|---|
| TOYOTAC-F7 | (parts by mass) | 5 | 5 | 5 | 0.5 | 22 | | |
| TOYOTAC-H3000P | (parts by mass) | | | | | | | |
| TOYOTAC-T | (parts by mass) | | | | | | | |
| TOYOTAC-KH | (parts by mass) | | | | | | | |
| TOYOTAC-TE | (parts by mass) | | | | | | | |
| Ester Wax (WEP-3) | (parts by mass) | 5 | 5 | | 5 | 5 | 5 | 5 |
| Paraffin Wax (HNP-9) | (parts by mass) | | | 5 | | | | |
| Pigment (YMCK) | (parts by mass) | 25 | 30 | 15 | 6 | 15 | 6 | 15 |
| Pigment Content in Toner * | | 19.6% | 22.6% | 12.8% | 5.5% | 12.8% | 5.5% | 12.8% |
| Weight Average Particle Diameter of Toner | [μm] | 4.2 ± 0.2 | 4.2 ± 0.2 | 4.2 ± 0.2 | 7.0 ± 0.2 | 4.2 ± 0.2 | 7.0 ± 0.2 | 4.2 ± 0.2 |

* Pigment content in toner is calculated with respect to 100% by mass of toner including external additives.

TABLE 2

| | | | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Comp. Ex. 1 | Comp. Ex. 2 |
|---|---|---|---|---|---|---|---|---|---|---|---|---|---|---|---|---|
| | Toner Set | | Set 1 | Set 2 | Set 3 | Set 4 | Set 5 | Set 6 | Set 7 | Set 8 | Set 9 | Set 10 | Set 11 | Set 12 | Set 13 | Set 14 |
| Styrene-Acryl Resin Coated PP Film | Drawing Fixing Temperature | (° C.) | 185 | 160 | 130 | 160 | 150 | 155 | 150 | 170 | 175 | 165 | 190 | 130 | 200> | 200> |
| | Tape Peeling Fixing Temperature | (° C.) | 190 | 165 | 135 | 165 | 150 | 160 | 155 | 175 | 180 | 170 | 195 | 130 | 200> | 200> |
| | Curling Evaluation | | C | A | A | A | A | A | A | A | A | A | A | A | — | — |
| PET Film | Drawing Fixing Temperature | (° C.) | 190 | 165 | 135 | 165 | 160 | 160 | 155 | 180 | 180 | 170 | 195 | 130 | 200> | 200> |
| | Tape Peeling Fixing Temperature | (° C.) | 190 | 170 | 140 | 170 | 160 | 165 | 160 | 180 | 185 | 175 | 200 | 130 | 200> | 200> |
| | Curling Evaluation | | B | A | A | A | A | A | A | A | A | B | B | A | — | — |

Embodiments of the present invention relate to the image forming method of (1) to (2) below and the image forming apparatus of (7) below.

(1) An image forming method comprising:

forming an electrostatic latent image on an electrostatic latent image bearer;

developing the electrostatic latent image on the electrostatic latent image bearer with a toner to form a toner image;

transferring the toner image from the electrostatic latent image bearer onto a continuous resin film;

fixing the toner image on the continuous resin film with a heat roller or a heat belt, wherein the toner contains a maleic-acid-modified polyolefin having a polypropylene block in a main chain.

(2) The image forming method of (1), wherein the maleic-acid-modified polyolefin having a polypropylene block in the main chain has a weight average molecular weight of 60,000 or more.

(3) The image forming method of (2), wherein the weight average molecular weight is 80,000 or more.

(4) The image forming method of any of (1) to (3), wherein the toner includes yellow toner, cyan toner, magenta toner, and black toner, wherein the yellow toner contains Pigment Yellow 185, the cyan toner contains a copper phthalocyanine pigment, and the magenta toner contains Pigment Red 122.

(5) The image forming method of (4), wherein a proportion of each pigment in each of the yellow toner, the cyan toner, the magenta toner, and the black toner is from 10% to 20% by mass.

(6) The image forming method of (4) or (5), wherein the transferring includes:

transferring the toner image from the electrostatic latent image bearer onto a continuous resin film via an intermediate image bearer.

(7) An image forming apparatus comprising:

an electrostatic latent image bearer;

an electrostatic latent image forming device configured to form an electrostatic latent image on the electrostatic latent image bearer;

a developing device accommodating a developer containing a toner, the developing device configured to develop the electrostatic latent image on the electrostatic latent image bearer with the developer to form a toner image;

a transfer device configured to transfer the toner image from the electrostatic latent image bearer onto a continuous resin film;

a fixing device configured to fix the toner image on the continuous resin film, wherein the toner contains a maleic-acid-modified polyolefin having a main chain containing a polypropylene block.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. An image forming method, comprising:

forming an electrostatic latent image on an electrostatic latent image bearer;

developing the electrostatic latent image on the electrostatic latent image bearer with a toner to form a toner image;

transferring the toner image from the electrostatic latent image bearer onto a continuous resin film;

fixing the toner image on the continuous resin film with a heat roller or a heat belt, wherein the toner contains a maleic-acid-modified polyolefin having a polypropylene block in a main chain, and a polyethylene block and a polybutene block, and wherein the maleic-acid-modified polyolefin having a polypropylene block in the main chain has a weight average molecular weight of 60,000 or more.

2. The image forming method of claim 1, wherein the weight average molecular weight is 80,000 or more.

3. The image forming method of claim 1, wherein the toner includes yellow toner, cyan toner, magenta toner, and black toner, wherein the yellow toner contains Pigment Yellow 185, the cyan toner contains a copper phthalocyanine pigment, and the magenta toner contains Pigment Red 122.

4. The image forming method of claim 3, wherein a proportion of each pigment in each of the yellow toner, the cyan toner, the magenta toner, and the black toner is from 10% to 20% by mass.

5. The image forming method of claim 3, wherein the transferring includes:

transferring the toner image from the electrostatic latent image bearer onto a continuous resin film via an intermediate image bearer.

6. An image forming apparatus, comprising:

an electrostatic latent image bearer;

an electrostatic latent image forming device configured to form an electrostatic latent image on the electrostatic latent image bearer;

a developing device accommodating a developer containing a toner, the developing device configured to develop the electrostatic latent image on the electrostatic latent image bearer with the developer to form a toner image;

a transfer device configured to transfer the toner image from the electrostatic latent image bearer onto a continuous resin film;

a fixing device configured to fix the toner image on the continuous resin film, wherein the toner contains a maleic-acid-modified polyolefin having a main chain containing a polypropylene block and wherein the maleic-acid-modified polyolefin having a polypropylene block in the main chain has a weight average molecular weight of 60,000 or more and has a polyethylene block and a polybutene block.

7. The image forming method of claim 1, wherein the weight average molecular weight is 60,000 to 100,000.

8. The image forming method of claim 1, wherein the weight average molecular weight is 80,000 to 100,000.

9. The image forming method of claim 1, wherein the maleic acid-modified polyolefin having a polypropylene block in the main chain has a maleic acid modification rate of from 0.5 to 8.0% by mass.

10. The image forming method of claim 1, wherein the proportion of the maleic acid-modified polyolefin having a polypropylene block in the main chain in the toner is 1.0 to 20.0% by mass.

11. The image forming method of claim 1, wherein the maleic acid-modified polyolefin having a polypropylene block in the main chain has a" outflow temperature of from 95° C. to 150° C.

12. The image forming method of claim 1, wherein the toner comprises wax as a release agent.

13. The image forming method of claim 12, wherein the proportion of the wax in the toner is from 0.1 to 8.0% by mass.

14. The image forming method of claim 1, wherein the weight average molecular weight is 60,000 to 200,000.

* * * * *